US010242824B2

(12) United States Patent
Gieger et al.

(10) Patent No.: US 10,242,824 B2
(45) Date of Patent: Mar. 26, 2019

(54) LOCKOUT DEVICE FOR SWITCHGEAR

(71) Applicant: Thomas & Betts International, LLC, Wilmington, DE (US)

(72) Inventors: Jeffrey S. Gieger, Dingmans Ferry, PA (US); Charles Bindics, Northhampton, PA (US)

(73) Assignee: Thomas & Betts International LLC, Wilmington, DE (US)

( * ) Notice: Subject to any disclaimer, the term of this patent is extended or adjusted under 35 U.S.C. 154(b) by 722 days.

(21) Appl. No.: 14/297,721

(22) Filed: Jun. 6, 2014

(65) Prior Publication Data

US 2014/0367233 A1 Dec. 18, 2014

Related U.S. Application Data

(60) Provisional application No. 61/835,715, filed on Jun. 17, 2013.

(51) Int. Cl.

| | |
|---|---|
| ***H01H 31/06*** | (2006.01) |
| ***H01H 3/22*** | (2006.01) |
| ***H01H 3/26*** | (2006.01) |

(52) U.S. Cl.

CPC ..... *H01H 31/06* (2013.01); *H01H 3/227* (2013.01); *H01H 3/26* (2013.01); *H01H 2300/024* (2013.01); *H01H 2300/056* (2013.01)

(58) Field of Classification Search

CPC ..... H01H 33/66; H01H 71/10; H01H 3/16
USPC ..... 200/43.16, 50.02
See application file for complete search history.

(56) References Cited

U.S. PATENT DOCUMENTS

| | | | |
|---|---|---|---|
| 2,529,032 | A | 11/1950 | Lindel |
| 3,883,208 | A | 5/1975 | Sankey et al. |
| 3,959,869 | A | 6/1976 | Wyman et al. |
| 4,137,779 | A | 2/1979 | Wustenberg et al. |

(Continued)

FOREIGN PATENT DOCUMENTS

| | | | |
|---|---|---|---|
| CA | 2163300 | | 5/1996 |
| DE | 4137779 | * | 5/1993 |

(Continued)

OTHER PUBLICATIONS

European Search Report dated Dec. 10, 2014.

*Primary Examiner* — Renee S Luebke
*Assistant Examiner* — Iman Malakooti
(74) *Attorney, Agent, or Firm* — Taft Stettinius & Hollister LLP

(57) ABSTRACT

A safety lockout device for switchgear includes a movable member adapted to be moved from a first position to a second position. A switch is adapted to electrically isolate a motor in the switchgear and a blocking arm is coupled to a shaft of the motor. In the first position, the movable member engages the switch to close the electrical motor circuit and the blocking arm is free to rotate with the motor shaft. In the second position, the movable member moves away from the switch so that the switch is in an open circuit state disconnecting power to the motor and a portion of the movable member is moved to a position whereby the blocking arm engages the movable member to prevent rotation of the motor shaft and a change of state of the switchgear. The position of the movable member relative to the switch provides a visual indication of the operating state of the switchgear.

16 Claims, 4 Drawing Sheets

(56) References Cited

U.S. PATENT DOCUMENTS

| | | | | |
|---|---|---|---|---|
| 4,190,755 | A | 2/1980 | Rogers | |
| 4,202,591 | A | 5/1980 | Borgstrom | |
| 4,513,208 | A | 4/1985 | Kamata | |
| 4,691,180 | A | 9/1987 | Grunert et al. | |
| 4,827,089 | A | 5/1989 | Morris et al. | |
| 5,025,171 | A | 6/1991 | Fanta et al. | |
| 5,034,575 | A | 7/1991 | Stewart | |
| 5,034,584 | A | 7/1991 | Fanta et al. | |
| 5,151,567 | A | 9/1992 | Thuries | |
| 5,181,164 | A | 1/1993 | Beard et al. | |
| 5,190,150 | A * | 3/1993 | Laue | H01H 13/14 200/341 |
| 5,196,658 | A | 3/1993 | Gula | |
| 5,197,594 | A | 3/1993 | Drexler et al. | |
| 5,254,814 | A | 10/1993 | Harr | |
| 5,691,518 | A | 11/1997 | Jones et al. | |
| 5,874,698 | A | 2/1999 | Collis | |
| 5,895,987 | A | 4/1999 | Lo et al. | |
| 5,945,648 | A | 8/1999 | M'Sadoques | |
| 6,025,657 | A | 2/2000 | Lo et al. | |
| 6,252,186 | B1 | 6/2001 | Liebetruth et al. | |
| 6,472,620 | B2 | 10/2002 | Rane et al. | |
| 6,479,770 | B2 | 11/2002 | Dahl et al. | |
| 6,989,498 | B1 | 1/2006 | Linder et al. | |
| 7,026,558 | B1 | 4/2006 | Andreyo | |
| 7,901,243 | B1 | 3/2011 | Yaworski | |
| 8,106,316 | B2 | 1/2012 | Manz | |
| 8,362,374 | B2 | 1/2013 | Grul et al. | |
| 8,389,880 | B2 | 3/2013 | Lee | |
| 2002/0100667 | A1 | 8/2002 | Leccia | |
| 2002/0170808 | A1 * | 11/2002 | Takano | H01H 3/161 200/50.02 |
| 2006/0070861 | A1 | 4/2006 | Bogdon et al. | |
| 2009/0108847 | A1 | 4/2009 | Hughes et al. | |
| 2010/0046146 | A1 | 2/2010 | Christensen et al. | |
| 2011/0217876 | A1 | 9/2011 | Siebens | |
| 2012/0119856 | A1 | 5/2012 | Prestini | |
| 2012/0199450 | A1 | 9/2012 | Bower et al. | |
| 2013/0088310 | A1 | 4/2013 | Yang et al. | |

FOREIGN PATENT DOCUMENTS

| | | |
|---|---|---|
| GB | 493648 | 10/1938 |
| GB | 2287831 | 9/1995 |
| JP | S60-107224 | 12/1985 |
| JP | 2002150897 | 5/2002 |
| JP | 2004014481 | 1/2004 |
| WO | WO 2011151278 | 12/2011 |
| WO | WO 2011161005 | 12/2011 |

* cited by examiner

LOCKOUT DEVICE FOR SWITCHGEAR

FIELD OF THE INVENTION

The present invention relates to a safety lockout device for switchgear and more particularly, to a device which electrically isolates the motor of the switchgear and mechanically blocks the motor from closing the switch.

BACKGROUND

During maintenance and/or repair of switchgear, it is important to ensure that power to the device is interrupted. While power may be shut off locally, many switchgear applications allow for remote operation. Thus, to ensure the safety of operators working on switchgear it would be useful to provide a device which electrically isolates the switchgear motor, provides a visual indication of the status of the switchgear and also provides a means to mechanically ensure the switchgear will not be operated from a remote location.

SUMMARY

Accordingly, it is an object of the invention to provide a device for switchgear which can act as a safety lockout to isolate the power to the switchgear and also provide a means to mechanically prevent energizing and operation of the switchgear from a remote location.

It is a further object of the invention to provide a safety lockout device for switchgear which can be operated using a hotstick.

These and other objects of the invention are achieved by the provision of a lockout switch including a means for electrically disconnecting the power to the motor, a means for mechanically blocking the motor from operating and a movable member operable by a hotstick to actuate the electrical disconnecting means and the mechanically blocking means. The electrical disconnecting means is preferably a limit switch in the form of push button and more preferably a ball limit switch which, when not depressed, interrupts the voltage to the motor. The means for mechanically blocking the motor from operating is preferably a blocking arm coupled to the motor shaft which engages the movable member if the motor is attempted to be operated. The movable member is preferably a linearly slideable bar.

In the preferred embodiment, the safety lockout device includes an axially slideable bar having a sufficient length to be placed into a first position in which the bar engages and depresses the ball limit switch. Thus, power is provided to the motor. In this first position the blocking arm is free to rotate along with the motor shaft and operate normally. Upon sliding the slideable bar to a second position, one end of the bar is moved away from the ball limit switch to expose the ball, i.e., not depressed, and voltage to the motor is interrupted. Also, the other end of the slideable bar is positioned to extend beyond the motor housing such that it provides a mechanical obstruction to engage the blocking arm and prevent operation of the switchgear motor. The slideable bar preferably includes an outwardly projecting eye with an opening, i.e., a hotstick loop, so that the safety lockout device can be operated from a safe distance by use of a hotstick.

DETAILED DESCRIPTION

Figure 1:
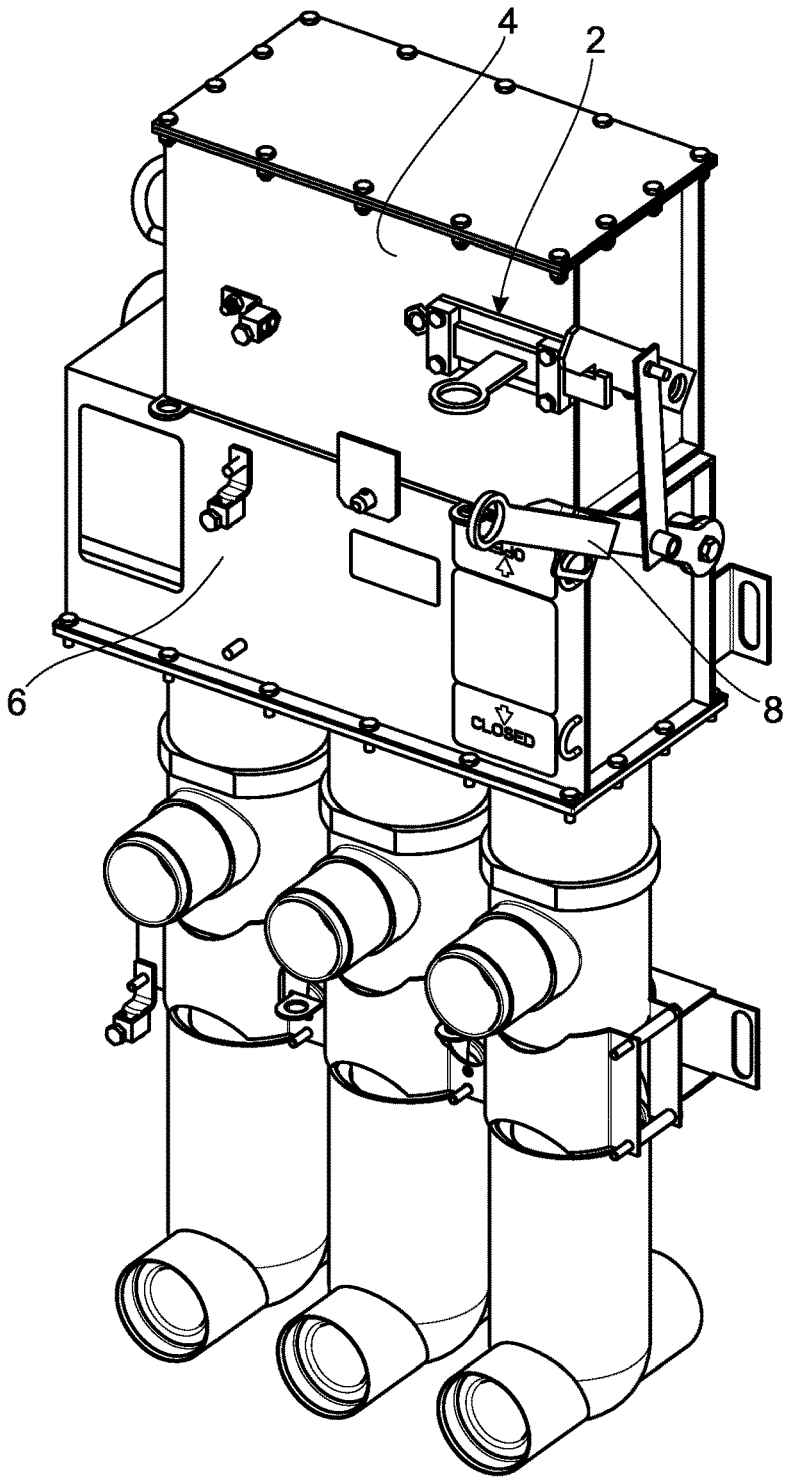
FIG. 1 illustrates the switchgear safety lockout device of the present invention mounted onto a motor box attached to a molded vacuum switch.

During maintenance and/or repair of switchgear, it is imperative that power to the drive motor be interrupted to prevent operation of the switchgear. The present invention is a safety lockout device which isolates power to a motor for operating the switchgear. The safety lockout device 2 as shown in FIG. 1 is mounted onto switchgear, in this case, a motor box 4 attached to a molded vacuum switch 6. The molded vacuum switch may be energized/de-energized by movement of an operating handle 8 having an opening in the end thereof to permit use of a hotstick. As shown in FIG. 1, the molded vacuum switch is in the open, un-energized position. To energize the switch, the operating handle is moved in a downward direction to close the electrical circuit. In the energized state, the motor can be operated to change the state of the switchgear.

Figure 2:
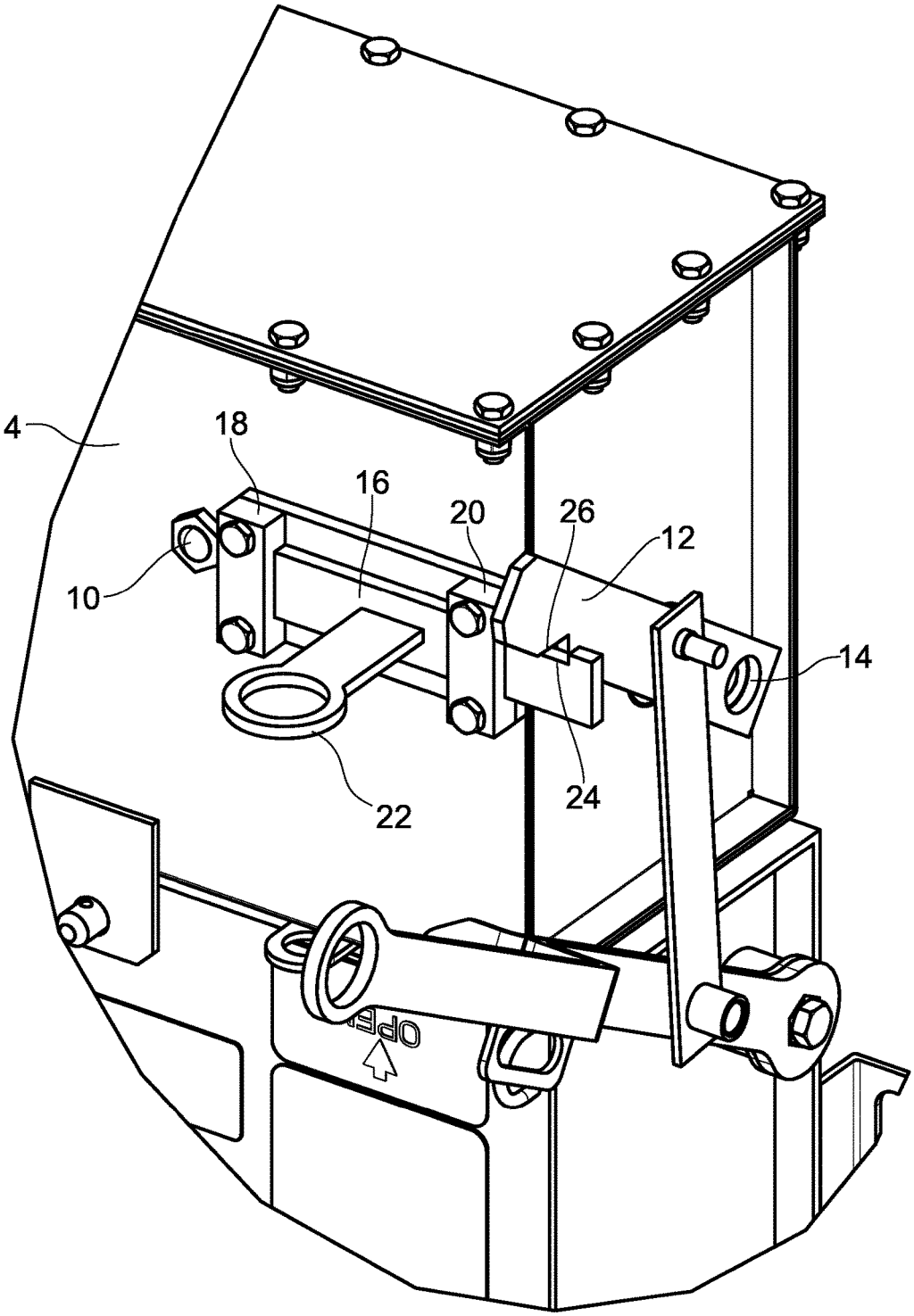
FIG. 2 illustrates a close-up view of the safety lockout device of FIG. 1 in a first position in which the switchgear motor is rendered inoperable.
Figure 3:
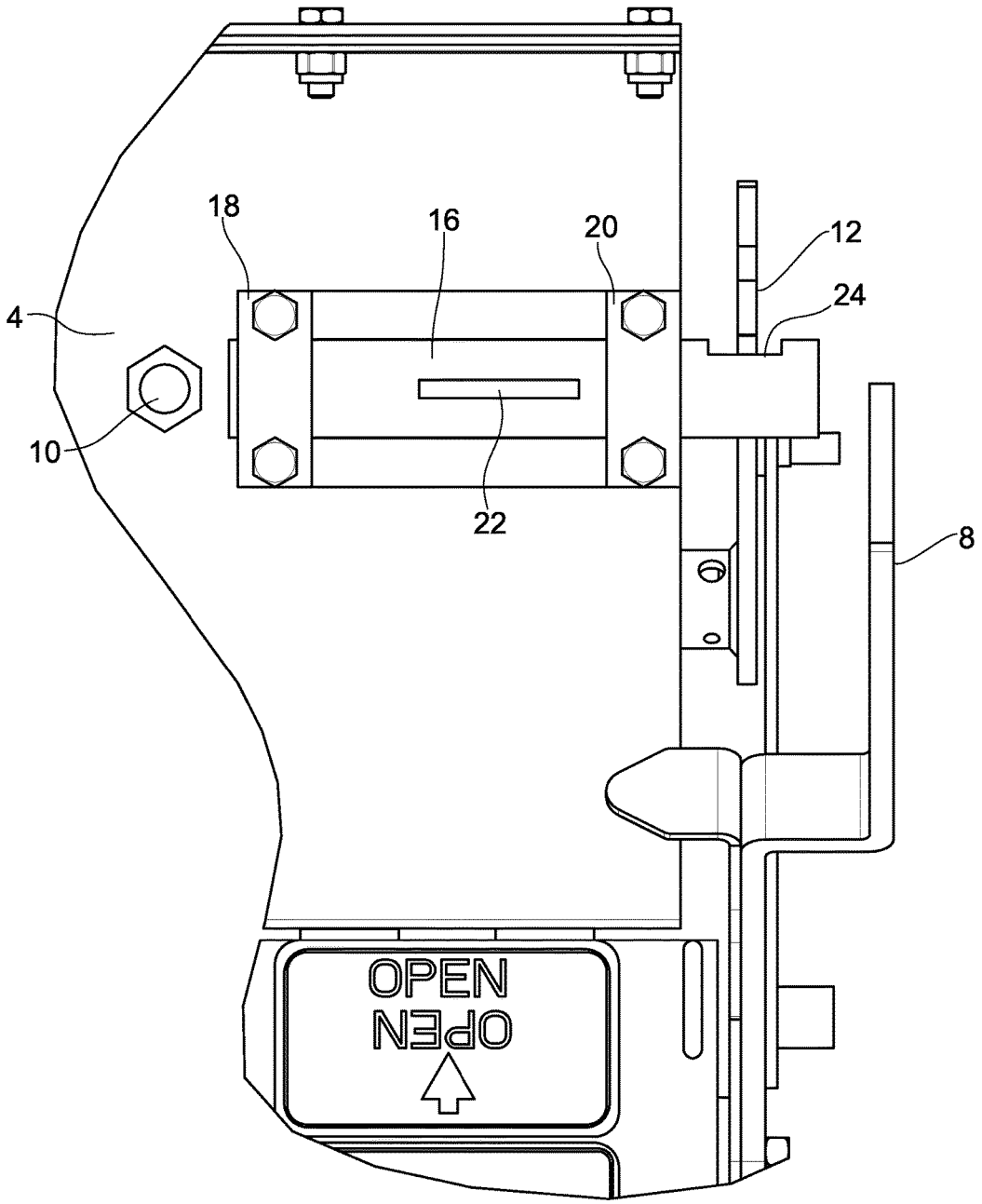
FIG. 3 illustrates a front view of the safety lockout device of FIG. 1.

FIGS. 2 and 3 illustrate an enlarged view of the safety lockout device of the present invention. The safety lockout device includes a means for electrically disconnecting the power of the motor. In a preferred embodiment as shown in FIGS. 2 and 3, the lockout device uses a ball limit switch 10 to interrupt power to the motor. More specifically, the ball limit switch is a single pole switch wherein when the ball is depressed, the circuit is closed and power passes to the motor controller. As shown in FIGS. 2 and 3, when the ball of the limit switch is not depressed, an open circuit is created interrupting power to the motor. It will be understood by those skilled in the art that other types of switches may be used to isolate power to the motor and fall within the scope of the invention.

Figure 4:
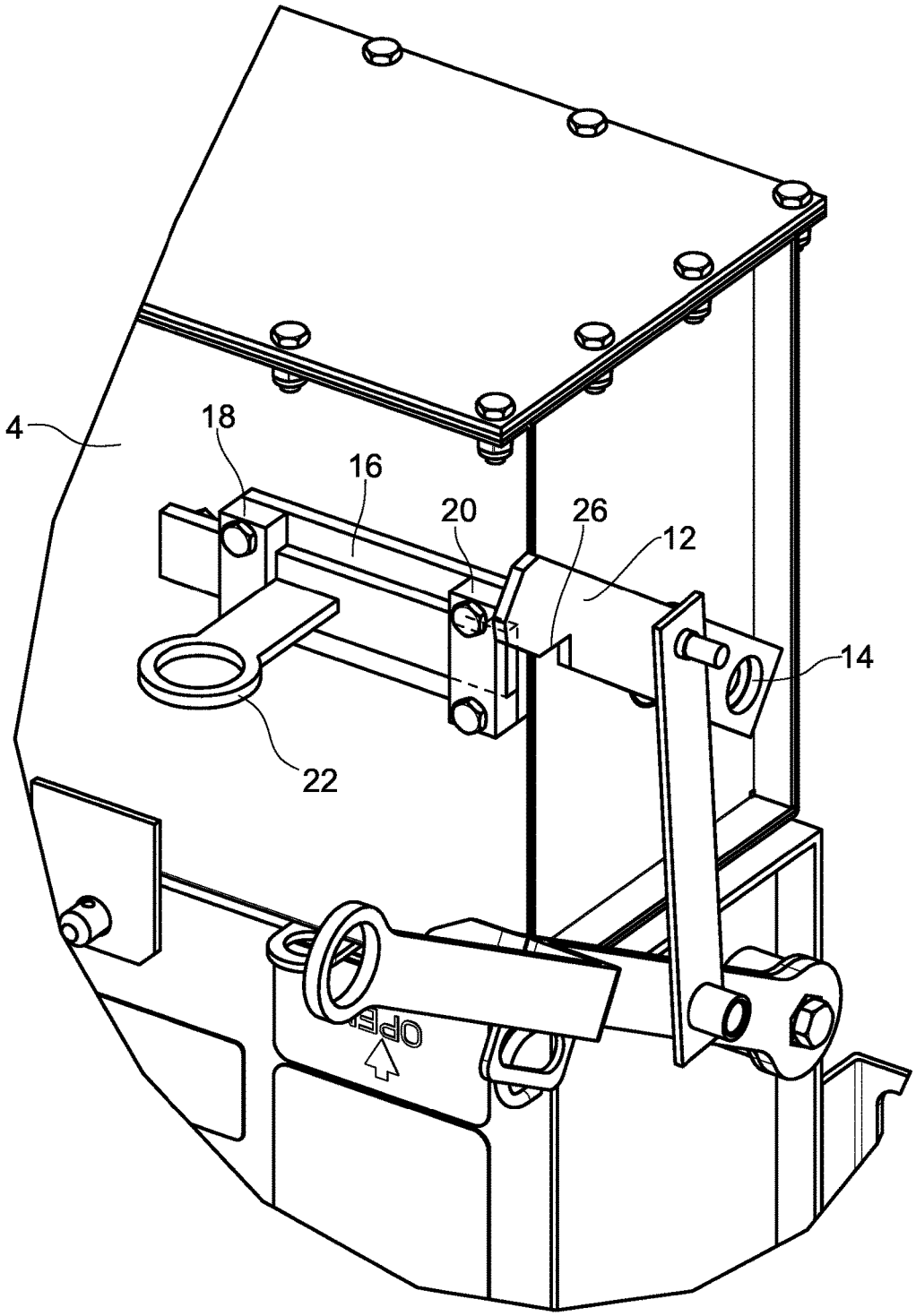
FIG. 4 illustrates a close-up view of the safety lockout device of FIG. 1 in a second position in which the switchgear motor is in operation mode.

As further illustrated in FIGS. 2 and 3, the safety lockout device also includes a means for mechanically blocking the motor from operating. In the preferred embodiment of FIGS. 2 and 3, the motor is mechanically blocked by a combination of a mechanical blocking arm 12 mounted to the motor shaft 14 which extends outside the periphery of the motor box 4. A movable member in the form of a slideable bar 16 is mounted to the outer surface of the motor box 4. The slideable bar is linearly movable to be in a first position as shown in FIG. 4 in which one end of the bar covers and depresses the ball limit switch 10 to close the electrical motor circuit and the opposite end of the bar is moved away from possible engagement with the blocking arm 12. Thus, in the first position, the switchgear is energized and can be operated normally.

As illustrated in FIGS. 2 and 3, the slideable bar 16 can be moved into a second position in which one end of the bar is moved to expose the ball limit switch 10 so that the ball is no longer depressed. In the second position, power is interrupted to the motor circuit. The opposite end of the slideable bar 16 moves linearly past the sidewall of the motor box so that should the motor unintentionally be energized, the blocking arm 12 would rotate with the motor shaft and engage the slideable bar thereby preventing the switch from changing state. Thus, in the second position, the motor is electrically isolated and the motor is also mechanically blocked from operating the switchgear to protect an operator performing maintenance and/or repair.

The slideable bar 16 is preferably mounted to the motor box using a pair of spaced apart brackets 18, 20. Each bracket includes an aperture for slidingly receiving the slideable bar 16. The slideable bar 16 also includes a hotstick loop 22 extending outwardly from a the motor box so that the slideable bar 16 may be moved from the first to the second position from a safe distance using a hotstick. As shown in FIGS. 2 and 3, the slideable bar 16 preferably includes a notch 24 on the engagement surface with the blocking arm 12. Similarly, the blocking arm 12 includes a notch 26 for engagement with the slideable bar upon unintentional energizing of the motor during maintenance or repair. Furthermore, the safety lockout device of the present invention is also adapted to operate when submersed.

The safety lockout device of the present invention also provides the operator with a visual indication of the state of the switchgear to determine whether it is safe to access the internals of the switchgear. For example, the operator can clearly see as shown in FIGS. 2 and 3 that in the second position, the limit switch 10 is exposed and the slideable bar 16 will engage the blocking arm if the motor is operated to prevent a change in state of the switchgear. Accordingly, the goals of electrically isolating the motor as well as providing a mechanical blocking means to prevent unintentional operation of the motor during maintenance and repair are achieved by the safety lockout device as described herein and shown in the figures.

Those skilled in the art will understand that the goals of the invention may be achieved using different component parts. For example, the slideable bar 16 may be replaced with a rotating and/or pivoting member to operate the ball limit switch 10 and engage the blocking arm 12 in the second position. Other modifications falling within the scope of the invention include different electrical switches and/or a modified blocking arm.

While there have been illustrated and described various embodiments of the present invention, it will be understood that various changes and modifications will occur to those skilled in the art. It is intended in the appended claims to cover all such changes and modifications that fall within the scope and spirit of the present invention.

What is claimed is:

1. A safety lockout device for switchgear comprising:

an electrical motor for operating the switchgear, the motor including a motor shaft having a portion extending outside a motor housing;

a movable member movably mounted on an exterior of the motor housing and adapted to be moved from a first position to a second position;

a switch mounted on the exterior of the motor housing, the switch being adapted to electrically isolate the motor in the switchgear; and a blocking arm coupled to the shaft of the motor, wherein in the first position, the movable member engages the switch to close the electrical motor circuit and the blocking arm is free to rotate with the motor shaft and wherein in the second position, the movable member moves away from the switch so that the switch is in an open circuit state disconnecting power to the motor and a portion of the movable member is moved to a position extending beyond the motor housing whereby the blocking arm engages the portion of the movable member which extends beyond the motor housing to prevent rotation of the motor shaft and a change of state of the switchgear, and wherein the position of the movable member relative to the switch provides a visual indication of the operating state of the switchgear.

2. A safety lockout device as defined in claim 1, wherein the moveable member is an axially slideable bar.

3. A safety lockout device as defined in claim 1, wherein the movable member includes a hotstick loop.

4. A safety lockout device as defined in claim 1, wherein the switch is a ball limit switch such that when the ball is depressed, the switch is closed and when the ball is not depressed, the switch is an open circuit interrupting power to the motor.

5. A safety lockout device as defined in claim 2, wherein the slideable bar is mounted to the exterior surface of the motor housing using a pair of spaced apart brackets having apertures therein so that the slideable bar moves axially within the bracket apertures.

6. A safety lockout device for switchgear comprising:

an electrical motor for operating the switchgear, the motor including a motor shaft having a portion extending outside a motor housing;

means for electrically disconnecting power to the motor mounted on an exterior surface of the motor housing;

means for mechanically blocking the motor from operating mounted on the motor shaft; and a movable member operable by a hotstick to actuate the electrical disconnecting means and to mechanically engage the mechanical blocking means at a location exterior to the motor housing;

wherein a position of the movable member relative to the electrical disconnecting means and mechanical blocking means provides a visual indication of the operating state of the switchgear.

7. A safety lockout device as defined in claim 6, wherein the electrical disconnecting means comprises a ball limit switch.

8. A safety lockout device as defined in claim 7, wherein the movable member can be moved to a first position in which the ball limit switch is depressed to close the switch and the movable member can be moved to a second position in which the ball limit switch is not depressed to open the switch.

9. A safety lockout device as defined in claim 6, wherein the mechanical blocking means comprises a blocking arm coupled to the motor shaft on the portion extending outside the motor housing, and wherein the movable member can be moved to a first position in which the blocking arm is free to rotate with the motor shaft and wherein the movable arm can be moved to a second position in which the blocking arm engages the movable member to prevent rotation of the motor shaft and a change of state of the switchgear.

10. A safety lockout device as defined in claim 6, wherein the movable member is a linearly slideable bar adapted to be moved from a first position to a second position, wherein in the first position, the electrical disconnecting means is a closed circuit to provide power to the motor and the mechanical blocking means is free to rotate with the motor shaft, and wherein in the second position, the electrical disconnecting means is an open circuit disconnecting power to the motor and an end of the movable member engages the blocking arm to prevent rotation of the motor shaft and a change of state of the switchgear.

11. A safety lockout device as defined in claim 6, wherein the movable member includes a hotstick loop.

12. A safety lockout device for switchgear comprising:

a motor box including an electrically operated motor mounted to the switchgear;

a single pole switch mounted on the exterior surface of the motor box and electrically connected to the motor, the switch having an open position and closed position;

a movable member mounted on an exterior surface of the motor box, the movable member being adapted to move between a first position and a second position; and a blocking arm coupled to a shaft of the motor extending outside the motor box, wherein in the first position, the movable member engages the switch to close the electrical motor circuit and the blocking arm is free to rotate with the motor shaft, and wherein in the second position, one end of the movable member does not engage the switch and the switch is in an open position interrupting power to the motor and the other end of the movable member extends beyond the motor box housing so that upon operation of the motor, the blocking arm engages the movable member to prevent rotation of the motor shaft and a change of state of the switchgear, and wherein the position of the movable member relative to the switch provides a visual indication of the operating state of the switchgear.

13. A safety lockout device as defined in claim 12, wherein the moveable member is an axially slideable bar.

14. A safety lockout device as defined in claim 12, wherein the movable member includes a hotstick loop.

15. A safety lockout device as defined in claim 12, wherein the switch is a ball limit switch such that when the ball is depressed, the switch is closed and when the ball is not depressed, the switch is an open circuit interrupting power to the motor.

16. A safety lockout device as defined in claim 13, wherein the slideable bar is mounted to a switchgear motor box using a pair of spaced apart brackets having apertures therein so that the slideable bar moves axially within the bracket apertures.

* * * * *